US005982251A

United States Patent [19]

Weinschel et al.

[11] Patent Number: 5,982,251

[45] Date of Patent: Nov. 9, 1999

[54] TUNER FOR RADIO FREQUENCY TRANSMISSION LINES

[75] Inventors: Bruno O. Weinschel, 9837 Canal Rd., Montgomery Village, Md. 20879; David E. Young, Mt. Airy, Md.

[73] Assignee: Bruno O. Weinschel, Montgomery Village, Md.

[21] Appl. No.: 09/039,306

[22] Filed: Mar. 14, 1998

Related U.S. Application Data

[60] Provisional application No. 60/042,434, Mar. 28, 1997.

[51] Int. Cl.[6] ..... H01P 1/00; H01P 5/00

[52] U.S. Cl. ..... 333/33; 324/645; 333/226; 333/263

[58] Field of Search ..... 333/33, 160, 207, 333/223, 224, 226, 245, 263; 324/638, 645

[56] References Cited

U.S. PATENT DOCUMENTS 2,267,539 12/1941 Thorne ..... 333/245 X
2,903,659 9/1959 Lombardi ..... 333/226
3,340,485 9/1967 Caron ..... 333/263 X
3,697,902 10/1972 Louvel ..... 333/33 X

OTHER PUBLICATIONS

Pp. 60–65 of the book "Microwave Impedance Measurements" by P.I. Somlo and J.D. Hunter, published by Peter Peregrinus, Ltd., London (1985).

P. 139 of the 1996/1997 catalog of Maury Microwave Corp. describing the Model 1643C tuner.

*Primary Examiner*—Paul Gensler
*Attorney, Agent, or Firm*—William D. Hall

[57] ABSTRACT

A tuner for radio frequency coaxial cable transmission lines is provided. It requires only one micrometer adjusting screw since the capacitor electrode that mates with the central conductor of the coaxial line is not only curved to give a large area in proximity to the central conductor but is rectangular and much longer than the diameter of the micrometer screw.

21 Claims, 4 Drawing Sheets

TUNER FOR RADIO FREQUENCY TRANSMISSION LINES

RELATED APPLICATION

This application is a continuation-in-part of our prior copending Provisional application Ser. No. 60/042,434, filed Mar. 28, 1997, and entitled: SINGLE SCREW SLIDE SCREW TUNER.

BACKGROUND OF INVENTION

The efficient transmission of generated radio frequency (RF) power to a suitable antenna has been an ongoing problem for years. Cable mismatch and resistance over long runs of several feet or more, adapter and connector mismatch, etc. result in significant loss of power to the antenna. A properly designed tuner placed between the problem mismatch and the antenna is known to result in significantly more power reaching the antenna. There are several coaxial designs existing today which solve this problem in varying degrees. One of these deigns is the Maury Microwave Corp.'s model 1643C (See page 139 of that company's 1996/1997 catalog). This coaxial device, as do others, makes use of two micrometer driven tuning stubs housed in one sliding carriage. Each tuning stub has a flat end movable toward or away from the central conductor of the coaxial cable to vary the capacity of the tuner. The two stubs are mounted on a carriage. The carriage is moved along the length of the transmission line to vary the phase of the tuner. The capacities of the stubs plus said phase shift provide the necessary impedance change to tune out power reflecting impedance change to tune out power reflecting mismatches. This principle is more thoroughly discussed on pages 60 to 65 of the book Microwave Impedance Measurement by P. I. Somlo and J. D. Hunter published by Peter Peregrinus Ltd., London (1985). Copies of said pages 60–65 and of said page 139 are included in the Information Disclosure Statement filed with this application for patent.

Thus, prior art slide screw tuners generally require a manipulation of two stubs and a carriage to achieve optimum results. To get good results is very time consuming even to the point of frustration. In addition most prior art tuners have a very limited tolerance for average and peak power handling. As shown in said book, 50 watts is a good indication of what is currently available.

SUMMARY OF INVENTION

In the prior art the amount of capacity between the stub-end and a central conductor is limited by (1) sparkover if the stub-end is too close to the central conductor, and (2) the diameter of the central conductor. In view of these limitations, a single stub is inadequate.

With our invention, a single stub is adequate as we use a curved capacitor electrode that is not only smooth (free of sharp points or edges) but has a stub-end that is concentric, or at least very roughly concentric, with the central conductor in at least one location of the micrometer screw. This increases the maximum capacity of a single stub. A further increase in capacity may be obtained by extending the concentric stub-end longitudinally along the central conductor.

Since only one stub is required, tuning is greatly simplified. Only two parameters need to be adjusted for optimum results. These two parameters are (1) the proximity of the single stub and the central conductor and (2) the position of that stub along the coaxial conductor.

As explained above, existing tuners can often be difficult to use, are time consuming and are limited in their power handling capacity. The result is that the user of the prior art tuners spends more money, than necessary, providing more power amplification instead of optimizing existing transmission of available power through tuning.

In our invention, we use only one tuning stub that requires no interaction with a second stub and we have increased the peak power capacity to 1 kW. This makes our tuner usable on many pulse radar systems and offers the user not only quicker tuning but also alternative applications that use coaxial configurations.

DETAILED DESCRIPTION

Figure 1:
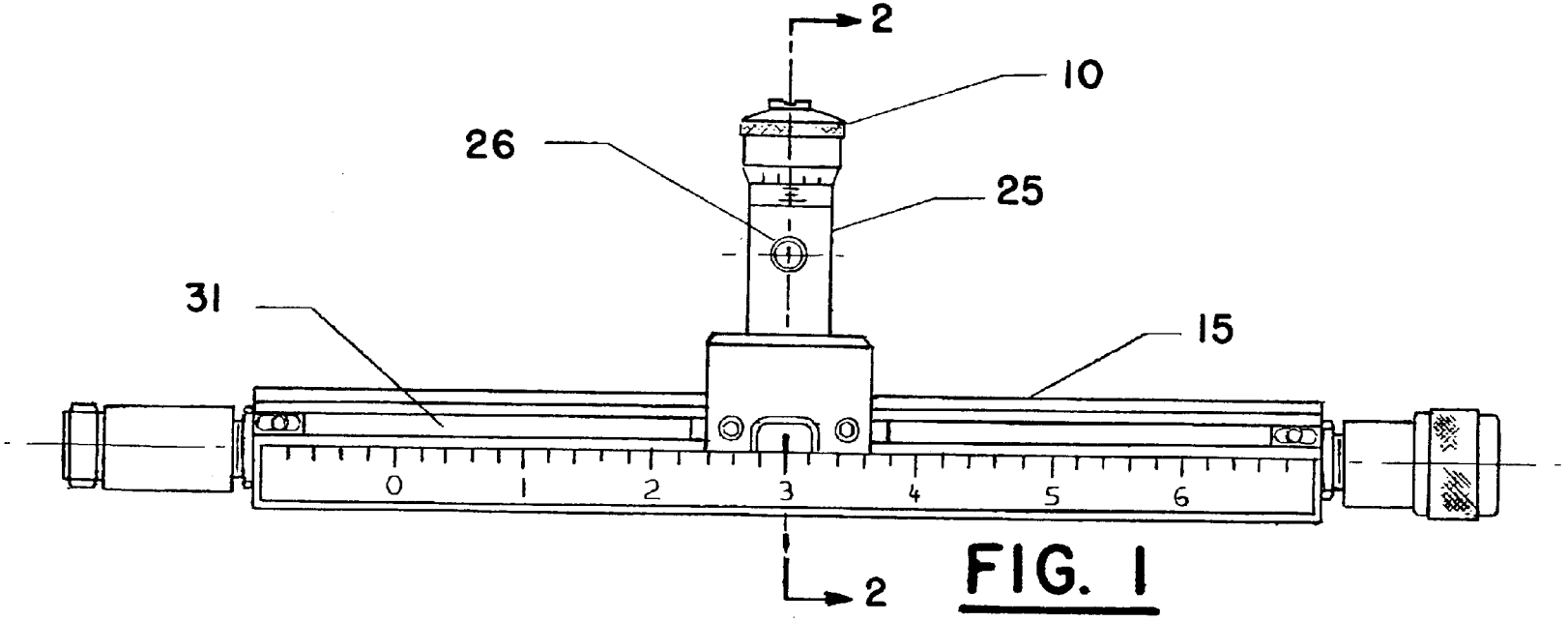
FIG. 1 is a side view of our new tuner
Figure 2:
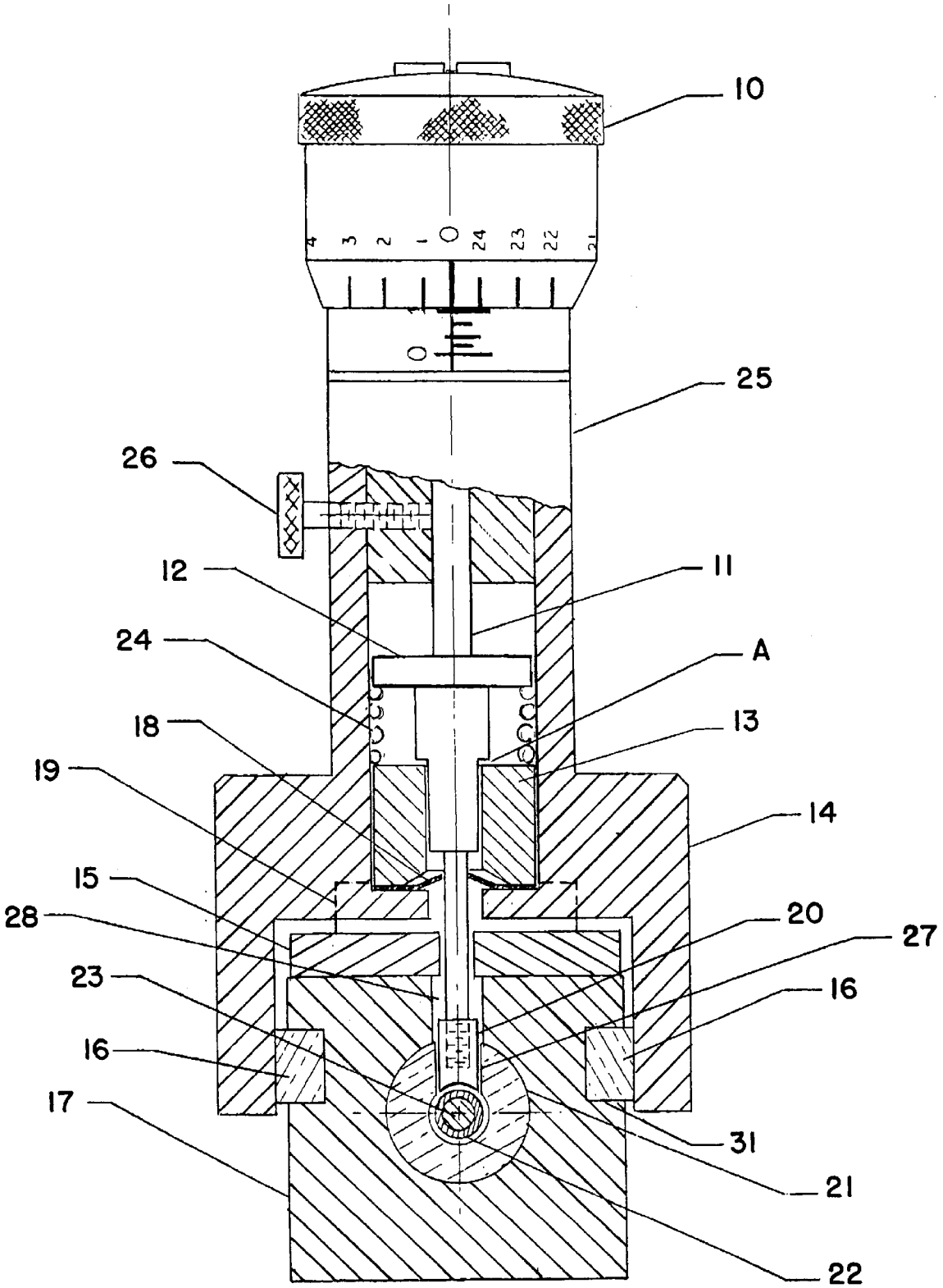
FIG. 2 is an end cross-sectional view taken along line 2—2 of FIG. 1.

FIG. 1 shows an overall view of our invention, a single stub sliding tuner. It has two type "N" coaxial connectors (in accordance with MIL-C-39012), each of opposite sex, one male one female. As seen in FIG. 2, a central conductor 23 is supported at each end by the connectors and along the entire length of the body by a Teflon insulator 21. The body 17 has a square cross-section (FIG. 2), with appropriate machining to support a movable carriage 14 and the micrometer adjustment stem 11. As discussed earlier, interaction of the carriage 14 and the micrometer adjustment stem 11, when introduced to a coaxial transmission line provides a tuning phenomenon producing a greater efficiency of transmitted power.

Figure 5:
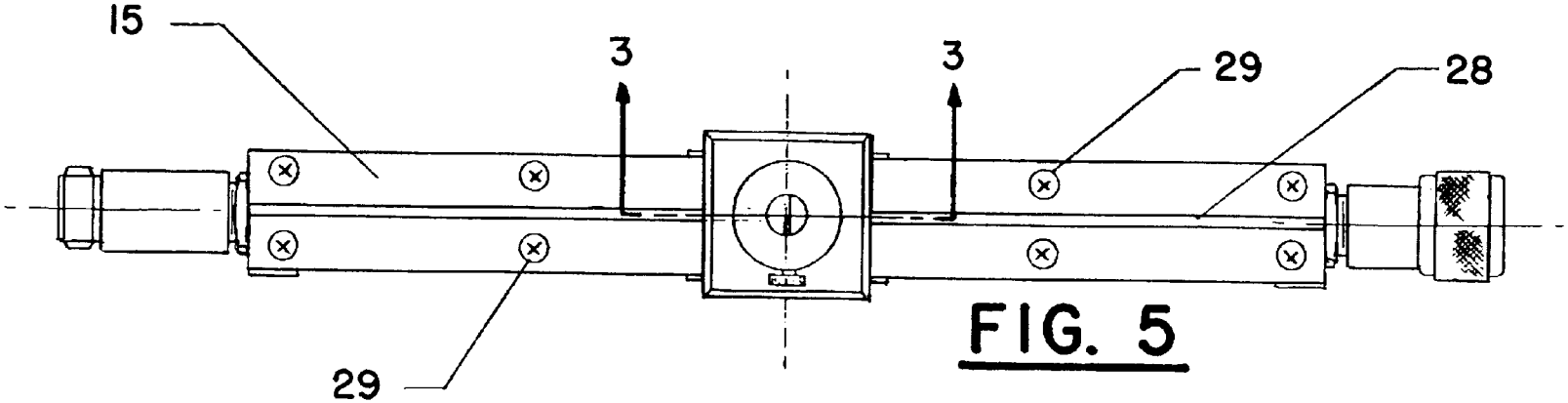
FIG. 5 is a top view of the tuner of FIG. 1.
Figure 3:
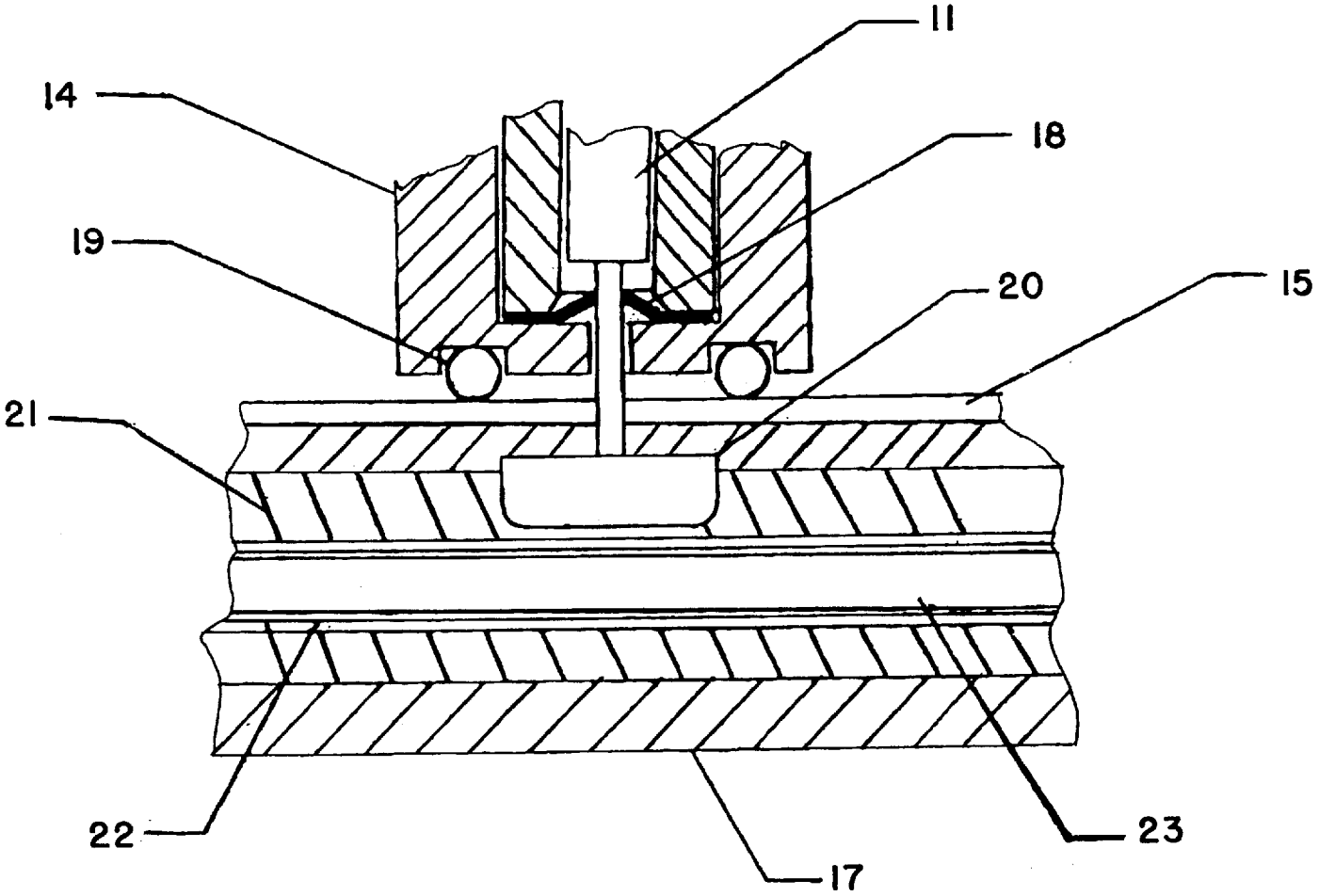
FIG. 3 is a cross-sectional view taken along line 3—3 of FIG. 5.
Figure 4:
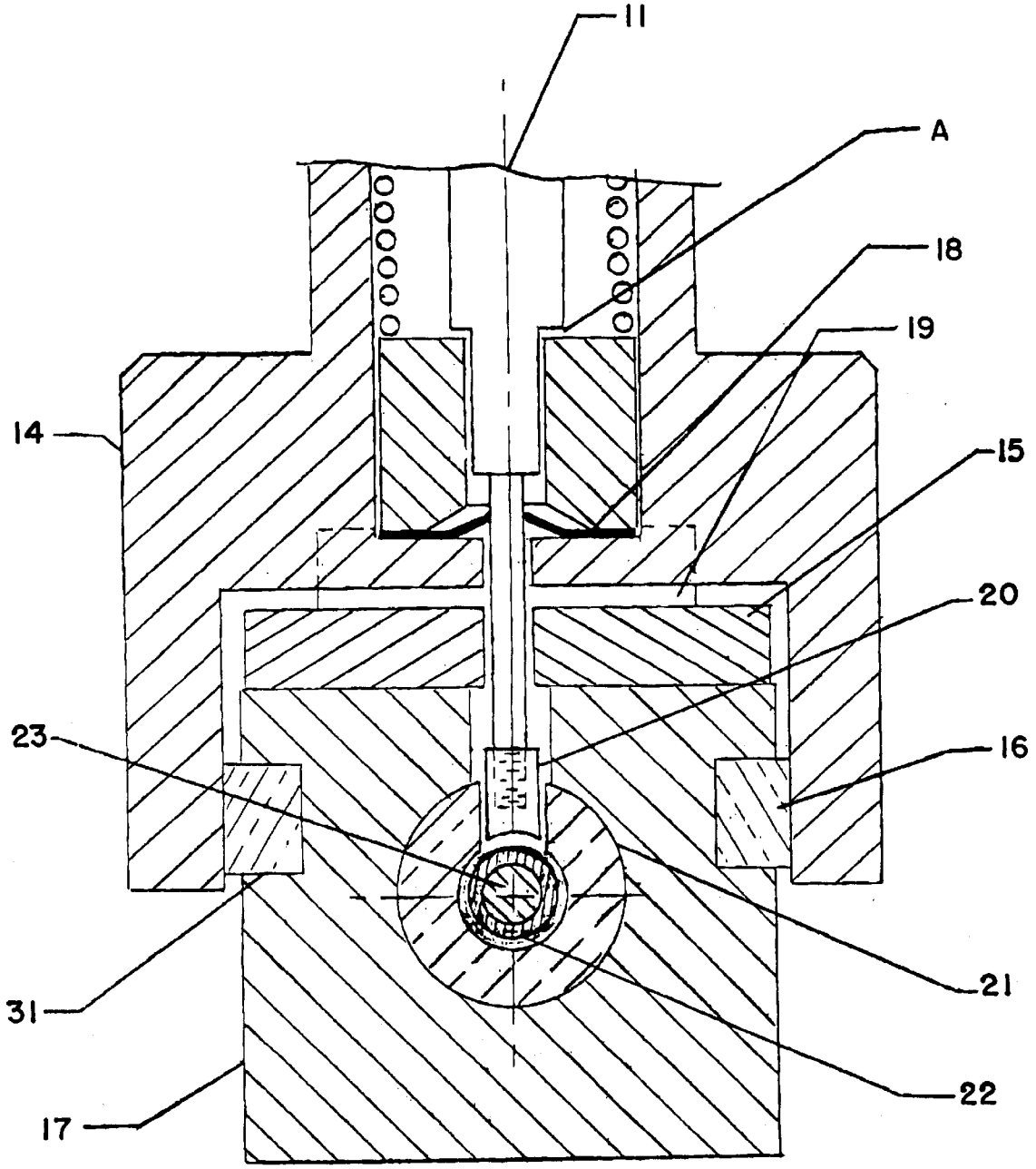
FIG. 4 is a cross-sectional of a limited portion of the tuner of FIGS. 1 to 3 and shows the capacitor element 20 and the central conductor 23.

FIG. 2 shows a cross section taken at 2—2 of FIG. 1. The micrometer body 25 is carried by the carriage 14. When the knurled adjusted knob 10 is rotated the stem 11 moves up and down. The spring 24 is in compression between the plunger 12 and the bushing 13. The spring pressure maintains a consistent interface between the rotating micrometer stem 11 and the nonrotating plunger 12. Since the foot 20 is threaded to the plunger 12 adjustment of the micrometer knob 10 causes movement of the foot 20 closer to or away from the central conductor 23. The proximity of the foot 20 to the central conductor 23 creates a variable capacitance between the foot 20 and central conductor 23. Note that the bottom of the foot 20 is concave and relatively concentric with the central conductor 23 allowing a closer proximity to and a greater capacitance with the central conductor 23. The shoulder on the plunger 12 at point A in FIGS. 2 and 3 provides a stop when contact is made with the bushing 13. This eliminates over insertion of the foot 20 and possible damage to the central conductor 23. The opening or slot 27 in the Teflon insulator 21 is only a few thousandths of an inch larger than the width of the foot 20 providing a guide during movement. Since the foot 20 is almost as wide as slot 27, the walls of slot 27 prevent rotation of foot 20 and guide that foot. The slot 27 in the insulator 21 is conversely smaller than the slot 28 in the body 17 eliminating the possibility of any contact at that interface. Locking screw 26 provides a lock that eliminates further movement of the foot 20 after optimum tuning has been achieved. It is very important to note that during any movement of the plunger 12 and foot 20 that they are maintained at the same ground potential as the carriage 14 by the resilient metallic star 18. The star 18 is compressed between the bushing 13 and the carriage 14. It is also important to note the contact between the metal carriage 14 and the metal top plate 15 and the metal body 17 are all at the same ground potential through the contact made by the metal sleeve 19 (See FIGS. 2, 3, and 4). The top plate 15 is fastened to the body 17 by screws 29 as shown in FIG. 5 (top view) and provides a smaller slot width to minimize any RF radiation that may occur during use.

Our invention allows for tuning of very high voltage transmission lines up to and including 1 KW. This is accomplished through the contour of the metallic foot 20. It has no sharp corners reducing the potential for areas of high current density and flash over. It is concave and concentric with the central conductor 23 increasing capacitance at a greater distance from the central conductor 23. The central conductor 23 is encased in an insulating material of polyolefin 22. These two features are unique and vertually eliminate flash over making it very useful in radar and other high voltage tuning applications. The surface of foot 20 that faces the central conductor 23 is a capacitor element.

The central conductor 23 diameter is slightly oversized with respect to the diameter of the hole in the body 17 to maintain a good 50 ohms impedance. The dielectric constant of the Teflon insulator 21, renders the body 17 slightly capacitive. This compensates for the slot in the body 17 which is slightly inductive. The combination of the two $X_C$ and $X_L$ combine to give nearly a 50 ohm impedance and a good match.

FIGS. 2 and 3 show the nylon slider 16 attached to the carriage 14 and inset in the machined channels 31 of the body 17. This allows for a smooth movement of the carriage 14 and foot 20 along nearly the entire length of the body 17 and central conductor 23. This movement along the length of the central conductor 23 will vary the phase of the tuner, allowing tuning regardless of wavelength or frequency. When it is desired to adjust the tuner by moving the carriage 14 along the length of the tuner, the carriage 14 is moved manually to thus slide the slider 16 (which is a projection integral with body 14) along the longitudinal slot 31 (which runs the full length of the tuner).

This invention is quite different than the prior art in that it minimizes tuning time by the use of only one tuning foot 20 which is longer than the diameter of the stem 11 but not longer than ⅛ wavelength eliminating the need for two stubs. The invention provides a greater range of capacitance due to the contour of the tuning foot 20 and the increased proximity of the foot 20 to the central conductor 23, readily tuning VSWR's to 2:1 resulting in reflected power of less than 1% in significantly less time than prior art with dual stubs. The invention provides for the transmission of higher power (to include 1 KW average and 3 KW peak power) since the spark-over voltage is higher.

Unlike the two-stub screw tuners, the capacitor element on foot 20 cannot rotate during tuning or movement of the carriage 14. Further unlike the two-stub tuners, the capacitor element on foot 20 is longer than the diameter of the stem 11 of the tuner; thus greatly increasing the available capacity.

We claim to have invented:

1. A tuner for coaxial radio frequency transmission lines, comprising:

a coaxial line of extended length, said coaxial line having a central conductor, said coaxial line having two ends one of which may be an input for radio frequency signals and the other end may act as an output for those signals, said outer conductor defining an elongated slit, that is parallel to said central conductor, a tuning element movable along said elongated slit to vary the tuning of said tuner, said tuning element having a capacitor element movable toward and away from said central conductor, to further vary the tuning of said tuning element, said capacitor element having a generally concave shape as viewed from an end of said central conductor, said capacitor element being the sole capacitor element, in the tuner, that moves toward and away from said central conductor.

2. A tuner as defined in claim 1 in which said capacitor element is substantially concentric with the center conductor in at least one of the positions that said capacitor element would have during its movement toward and away from said central conductor.

3. A tuner as defined in claim 2 having means for preventing rotation of said capacitor element when that element is moved toward and away from said central conductor.

4. A tuner as defined in claim 3 in which means prevents rotation of said capacitor element when that element is moved longitudinally in a direction parallel to said central conductor.

5. A tuner as defined in claim 4 in which said tuning element includes a micrometer for effecting said movement of said capacitor element toward and away from said central conductor.

6. A tuner as defined in claim 1 in which said signals have a wavelength, said capacitor element having a length that does not exceed one-eighth of said wavelength.

7. A tuner as defined in claim 1 in which said outer conductor has inductance due to said slit and means for compensating for said inductance.

8. A tuner as defined in claim 1 in which said capacitor element is free of sharp corners.

9. A tuner as defined in claim 1 in which said tuning element and said capacitor are maintained at ground potential.

10. A tuner for coaxial radio frequency transmission lines, including:

a coaxial cable of extended length, said cable having a central conductor, and an outer conductor, said cable having two ends one of which may be an input for radio frequency signals and the other end may act as an output for those signals, said outer conductor defining an elongated slit, that is parallel to said central conductor, a tuning element movable along in said elongated slit to vary the tuning of said tuner, said tuning element also having a capacitor element movable toward and away from said central conductor to further vary the tuning of said tuning element, and means for moving said capacitor element toward and away from said central conductor without rotating said capacitor element, the improvement comprising:

said capacitor being the sole capacitor element, in the tuner, that moves toward and away from said central conductor.

11. A tuner as defined in claim 10 in which said means includes a micrometer for moving said capacitor element toward and away from said central conductor.

12. A tuner as defined in claim 10 including means for guiding said capacitor element and preventing rotation thereof when said element is moved in a direction parallel to said central conductor.

13. A tuner as defined in claim 10 having means for maintaining said capacitor element at ground potential.

14. A tuner as defined in claim 13 having means for maintaining said outer conductor at ground potential.

15. A tuner for coaxial radio frequency transmission lines, comprising:

a coaxial line of extended length, said coaxial line having a central conductor, said coaxial line having two ends one of which may be an input for radio frequency signals and the other end may act as an output for those signals, said outer conductor defining an elongated slit, that is parallel to said central conductor, a tuning element movable along said elongated slit to vary the tuning of said tuner, said tuning element also having a capacitor element, a manually movable device for moving said capacitor element toward and away from said central conductor to further vary the tuning of said tuning element, said capacitor element being long, in the direction parallel to the central conductor, as compared to the diameter of said micrometer screw, in said direction, said capacitor element being the sole capacitor element, in the tuner, that moves toward and away from said central conductor.

16. A tuner as defined in claim 15 in which said elongated slit has a length, said capacitor being shorter, in a direction parallel to said slit, than said length.

17. A tuner as defined in claim 16 which said capacitor element is concave as viewed from an end of said central conductor.

18. A tuner as defined in claim 15 wherein said manually movable device incudes a micrometer for moving said capacitor element toward and away from said central conductor.

19. A tuner as defined in claim 15 wherein said capacitor element has a rectangular cross section in a plane parallel to said central conductor, said rectangle having its longer sides parallel to said central conductor.

20. A tuner as defined in claim 19 in which said radio frequency signals have a wavelength, said longer sides being no longer than ⅛ of said wavelength.

21. A tuner as defined in claim 15 having means for maintaining said tuning element and said capacitor element at ground potential.

* * * * *